US007198159B2

(12) United States Patent
Fischer

(10) Patent No.: US 7,198,159 B2
(45) Date of Patent: Apr. 3, 2007

(54) SLATWALL EXTRUSION AND ASSEMBLY

(76) Inventor: James R. Fischer, 1717 Twin Oaks La., Sheboygan, WI (US) 53083

( * ) Notice: Subject to any disclaimer, the term of this patent is extended or adjusted under 35 U.S.C. 154(b) by 158 days.

(21) Appl. No.: 10/736,000

(22) Filed: Dec. 15, 2003

(65) Prior Publication Data

US 2005/0127016 A1 Jun. 16, 2005

(51) Int. Cl.
*A47F 5/08* (2006.01)

(52) U.S. Cl. ..... 211/94.01; 211/87.01; 211/189

(58) Field of Classification Search ..... 211/94.01, 211/87.01, 189
See application file for complete search history.

(56) References Cited

U.S. PATENT DOCUMENTS 3,045,961 A * 7/1962 Cygan ..... 248/222.12
3,698,565 A * 10/1972 Weber ..... 211/87.01
4,407,476 A * 10/1983 Bohannan ..... 248/235
4,450,970 A * 5/1984 Shepherd ..... 211/189
4,607,753 A * 8/1986 Radek ..... 211/94.01
4,672,789 A * 6/1987 Fortier ..... 52/520
4,678,151 A * 7/1987 Radek ..... 248/223.41
4,694,965 A * 9/1987 Parnell ..... 211/87.01
4,703,861 A * 11/1987 Hart et al. ..... 211/189
4,750,624 A * 6/1988 Baron ..... 211/87.01
4,809,479 A * 3/1989 Tierno et al. ..... 52/588.1
4,891,897 A * 1/1990 Gieske et al. ..... 40/618
4,961,295 A * 10/1990 Kosch et al. ..... 52/36.5
5,018,323 A * 5/1991 Clausen ..... 52/36.4
5,655,674 A * 8/1997 Holztrager ..... 211/94.01
5,791,093 A * 8/1998 Diamond ..... 52/36.5
D400,270 S 10/1998 Current ..... D25/123
5,819,490 A 10/1998 Current ..... 52/588.1
D403,085 S 12/1998 Current ..... D25/123
5,899,344 A 5/1999 Current et al. ..... 211/94.01
5,941,026 A * 8/1999 Eisenreich et al. ..... 52/36.5
5,944,203 A * 8/1999 Vlah et al. ..... 211/189
6,164,467 A * 12/2000 DePottey et al. ..... 211/189
6,439,399 B1 * 8/2002 Wegstein et al. ..... 211/55
6,837,384 B2 * 1/2005 Secondino ..... 211/87.01
6,941,707 B2 * 9/2005 Sigmund ..... 52/95
6,971,614 B2 * 12/2005 Fischer et al. ..... 248/220.43

OTHER PUBLICATIONS

"Tooling Triad", Gardner Publications, Inc., reprint of Sep. 2001 Modern Machine Shop Magazine article.
"Slatwall Systems" brochure, Jifram Extrusions, Inc., 2000.
"Extrusion and Fabrication Tooling" brochure, CPC Tooling Technologies, published prior to Dec. 15, 2002.

* cited by examiner

*Primary Examiner*—Peter M. Cuomo
*Assistant Examiner*—Lindsay M. Maguire
(74) *Attorney, Agent, or Firm*—Jeffrey S. Sokol; Cook & Franke S.C.

(57) ABSTRACT

A slatwall extrusion and assembly for a wall of a building to support hangers and shelving and the items they carry. Each section of slatwall has a continuous linear rear wall that integrally joins number of spaced boards. Each board has front, rear, top and bottom walls that form a continuous loop around a hollow interior. Each board also has a downwardly extending double-walled lip. The lip is spaced from its adjacent lower board to form an L-shaped slot. The continuous rear wall is firmly secured to the studs or drywall of the wall by self tapping screws or an adhesive coating. The linear rear wall, hoop shaped boards, and double-walled lips combine to form a sturdy, lightweight and inexpensive slatwall extrusion. High impact polystyrene (HIPS) is used to achieve even further cost and weight reductions while maintaining the strength of the slatwall extrusion and assembly.

20 Claims, 5 Drawing Sheets

SLATWALL EXTRUSION AND ASSEMBLY

TECHNICAL FIELD OF THE INVENTION

The present invention relates to a slatwall extrusion having a continuous rear wall and spaced boards that define slots for receiving and supporting hangers, and an assembly of these slatwall extrusions secured to a wall of a building.

BACKGROUND OF THE INVENTION

Slatwall is formed by a number of spaced horizontal boards that form uniform slots between adjacent boards. The boards have a lip that forms a slot for removably receive cooperating hangers that press against and grip one board and one lip to support the hanger and resist downward forces such as the weight of an object. The hangers are free to pivot upwardly to release from the slatwall for repositioning or removing the hangers. The hangers support items that hang directly from them or support shelving upon which those items are placed. Slatwall is commonly used in a wide variety of residential, retail and commercial setting to display and store a wide variety of items.

Slatwall is commonly extruded from plastics such as rigid PVC. Extruded slatwall sections have been formed to include a number of boards as in U.S. Pat. No. 5,899,344, the disclosure of which is incorporated by reference. Unfortunately, there are several problems with conventional plastic extrusions. One problem is the trade off between the physical characteristics and cost of the plastic material used to make the slatwall extrusion. Rigid PVC has a relatively high viscosity due to fillers such as lime stone and clay. This material tends to hold its cross-sectional profile during the heated extrusion process so that it is easy with which to work. Although rigid PVC is relatively strong, it is fairly expensive and rather heavy. Rigid PVC costs about $1.00 a pound and has a specific gravity of about 1.4 to 1.5. As a result, slatwall assemblies made from this material tend to be expensive and cumbersome with which to work.

Another problem with conventional slatwall extrusions is that they should be fairly rigidity. The slatwall extrusion should deform as little as possible when loaded, particularly at the top wall and lip supporting the hanger and along its rear surface where the slatwall is secured to the supporting wall. Yet, to reduce the amount of material and cost of the slatwall, channels may be formed along the rear wall. The front surface of the boards typically remain flat to achieve a desired appearance. The size of the channel along the rear of each board is restricted to maintain the strength. If the channel is too deep or too wide, the slatwall may bow or otherwise deform under load and allow one or more hangers to pop out. Cyclically loading and unloading items supported by the hangers and slatwall as items are sold and restocked tends to flex the rear wall of the slatwall where the fasteners secure it to the wall. This can loosen the fasteners and allow them to break free, causing a hanger or shelf to slip and its contents to fall and break. People in the vicinity could be injured by heavy or sharp objects. Should one of the top portions of the slatwall or hangers give way, a cascading effect could result.

A further problem with conventional slatwall extrusions is that their extrusion profile is intended for mechanical fasteners to secure the slatwall to a supporting surface. Screws or nails are typically located in the slots at spaced locations. These mechanical fasteners work well when properly driven into the wall studs at properly spaced intervals, but can be problematic when some of the fasteners inadvertently miss their intended stud. Many modern building constructions use metal studs at varying increments that can be difficult to locate. Metal studs also do not readily receive ordinary screws by workers using ordinary tools. Mechanical fasteners such as screws are also less effective and reliable when secured to drywall. The end result is a poorly installed and unsafe slatwall assembly.

The present invention is intended to solve these and other problems.

BRIEF DESCRIPTION OF THE INVENTION

The present invention pertains to a slatwall extrusion and assembly for a wall of a building to support hangers and shelving and the items they carry. Each section of slatwall has a continuous linear rear wall that integrally joins number of spaced boards. Each board has front, rear, top and bottom walls that form a continuous loop around a hollow interior. Each board also has a downwardly extending double-walled lip. The lip is spaced from its adjacent lower board to form an L-shaped slot. The continuous rear wall is firmly secured to the studs or drywall of the wall by self tapping screws or an adhesive coating. The linear rear wall, hoop shaped boards, and double-walled lips combine to form a sturdy, lightweight and inexpensive slatwall extrusion. High impact polystyrene (HIPS) is used to achieve even further cost and weight reductions while maintaining the strength of the slatwall extrusion and assembly.

One advantage of the present slatwall extrusion invention is its strength and resistance to deformation. The continuous linear rear wall and hoop shaped boards provide a structurally strong slatwall geometry having an excellent weight to load ratio, or ratio of weight per linear foot of slatwall to maximum allowable load of the slatwall. The top walls of the boards support the weight of the items and transmit the load to the continuous rear wall. The continuous hoop construction helps prevent the top walls from unduly deforming under load so that the hangers remain engaged with the lip of the immediately adjacent upper board. In addition, the double-wall lip construction provides added strength to resist deformation and keep the hangers in their slots under load. The continuous rear wall further increases the strength of the slatwall by uniformly engaging, laying flush against and being uniformly buttressed by the drywall layer of the wall, which helps prevent the rear wall from buckling or twisting when the top walls and lips of the slatwall are under load. The continuous rear wall is also uniformly anchored to the wall by uniformly spaced screws or a uniformly applied adhesive coating. The continuous flush engagement and uniform securement helps further resist deformation of the continuous rear wall, which gives the boards a solid rear base layer from which to extend. The slatwall construction is particularly suited for cyclically loading and unloading without excessive loosening its screw fasteners that secure it to the wall. These factors combine to produce a stronger and safer slatwall construction capable of supporting significant loads.

Another advantage of the present slatwall extrusion invention is its lightweight construction and inexpensive cost. The hollow interior of each board significantly reduces the volume of plastic material per linear foot of slatwall section, which reduces the weight and cost of the slatwall section. In addition, the slatwall sections can be extruded using a HIPS material. While rigid PVC costs about $1.00 a pound and has a specific gravity of about 1.4 to 1.5, the HIPS material costs about $0.50 a pound and has a specific gravity of about 1.04. The HIPS material provides an additional fifty percent savings in material costs and a thirty percent reduction in weight.

A further advantage of the present slatwall extrusion invention is its extrusion profile allows either mechanical fasteners or adhesives to secure it to a supporting wall. The continuous flat rear surface lays flush against a wall so that adhesives can be easily applied in a generally continuous manner over its rear surface to achieve more uniform securement to the wall. Self tapping screws also easily pass through the material so that it can be anchored at uniformly spaced horizontal and vertical locations along its slots to secure it to the wall. The ability to use both mechanical fasteners and adhesives enables the slatwall to be securely attached to wall studs or directly to the outer drywall layer of a wall when the studs are difficult to find or are difficult to penetrate with self tapping screws and ordinary tools.

A still further advantage of the present slatwall extrusion is its manufacturability. The HIPS material has a relatively low viscosity when heated and is generally considered to be too difficult with which to work for hollow core extrusion processes. However, it has been found that sizing equipment can used to achieve the desired multi-loop board extrusion profile along with a flat continuous rear wall construction. With proper skill an operator can use a conventional vacuum sizing system to form the slatwall sections. The use of HIPS material dramatically reduces the cost of slatwall extrusions, with the savings being passed on to the customer.

Other aspects and advantages of the invention will become apparent upon making reference to the specification, claims and drawings.

DESCRIPTION OF THE PREFERRED EMBODIMENTS

Figure 1:
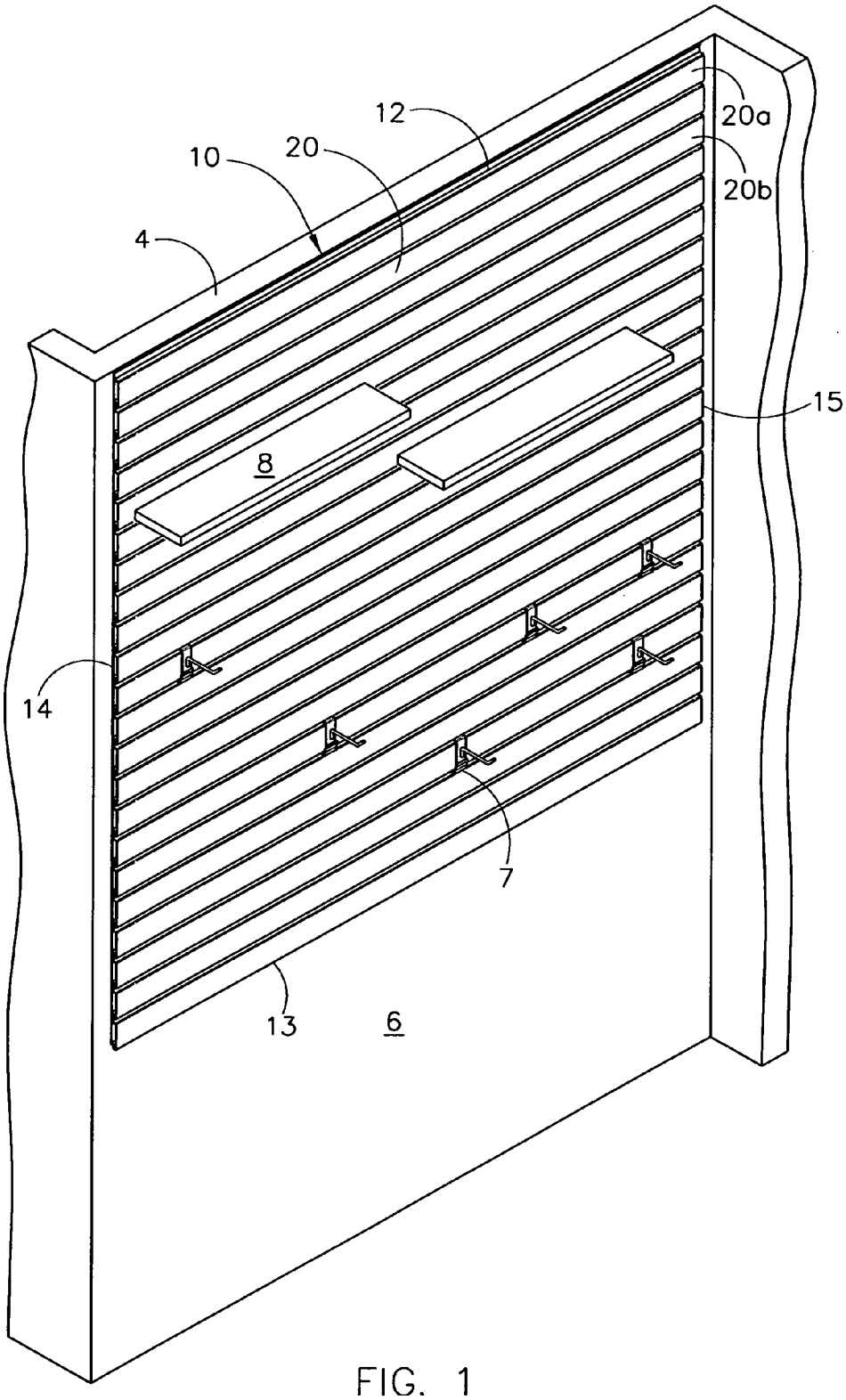
FIG. 1 is a perspective view of the slatwall assembly invention mounted to a wall to support conventional slatwall hangers and shelving.

While this invention is susceptible of embodiment in many different forms, the drawings show and the specification describes in detail preferred embodiments of the invention. It should be understood that the drawings and specification are to be considered an exemplification of the principles of the invention. They are not intended to limit the broad aspects of the invention to the embodiments illustrated.

Residential and commercial buildings generally have walls 4 with spaced, vertically aligned, wooden or metal studs 5 that form a vertical plain to which an attractive outer layer is fastened such as a layer of drywall 6 with a flat outer surface. The present invention relates to a slatwall assembly 10 generally shown in FIG. 1, and the individual slatwall sections 20 that form the assembly as generally shown in FIG. 2. The planar assembly 10 has an attractive uniform appearance from top 12 to bottom 13 and side 14 to side 15. The assembly 10 is formed by a number of elongated slatwall sections 20 mounted in a vertically planar and lengthwise abutting series, one beneath the other, with each section 20 horizontally parallel to its adjacent section or sections. The assembly 10 is secured directly to the aligned sides of the studs 5 as in FIG. 3, or directly over the outer surface of the drywall 6 as in FIG. 4. The assembly 10 and each of its sections 20 are parallel to the vertical plain of the wall 4, and are flush against and rigidly secured to its studs 5 or drywall layer 6. Conventional slatwall hangers 7 and shelving 8 are mounted to and supported by the assembly 10. Each hanger 7 and shelf unit 8 has a mounting bracket 9 with an elongated, substantially linear or flat, lower portion 9*a* and an inwardly offset, upper portion 9*b* for securing it to the slatwall 10.

Each slatwall section 20 is made of plastic and has a one-piece or unibody construction 21 with top and bottom ends 22 and 23 and opposed sides 24 and 25. The extruded sections 20 have a generally uniform profile across their entire extent. The sections 20 are preferably extruded from high impact polystyrene (HIPS), although rigid PVC and other extrudable plastic materials could be used, provided they produce a sufficiently strong and durable slatwall construction. Conventional extrusion equipment is used to extrude the sections 20. When HIPS material is used, a conventional vacuum sizing system is incorporated such as that manufactured by CPC Tooling Technologies of Columbus, Ohio. Each slatwall section 20 includes two boards 30 such as upper and lower board 31*a* and 31*b* in FIGS. 1–4, but can include additional middle boards 31*c* as in FIGS. 5 and 6. The boards 30 are parallel to each other as well as to the top and bottom ends 22 and 23 of its section 20. It should be understood that the embodiments having three boards 31*a*–*c* per slatwall section 20, the middle board 31*c* is the upper board of its adjacent lower board 31*b* and the lower board of its adjacent upper board 31*a*. A similar analogy applies for embodiments having four or more boards 31*a*–*c*.

Figure 2:
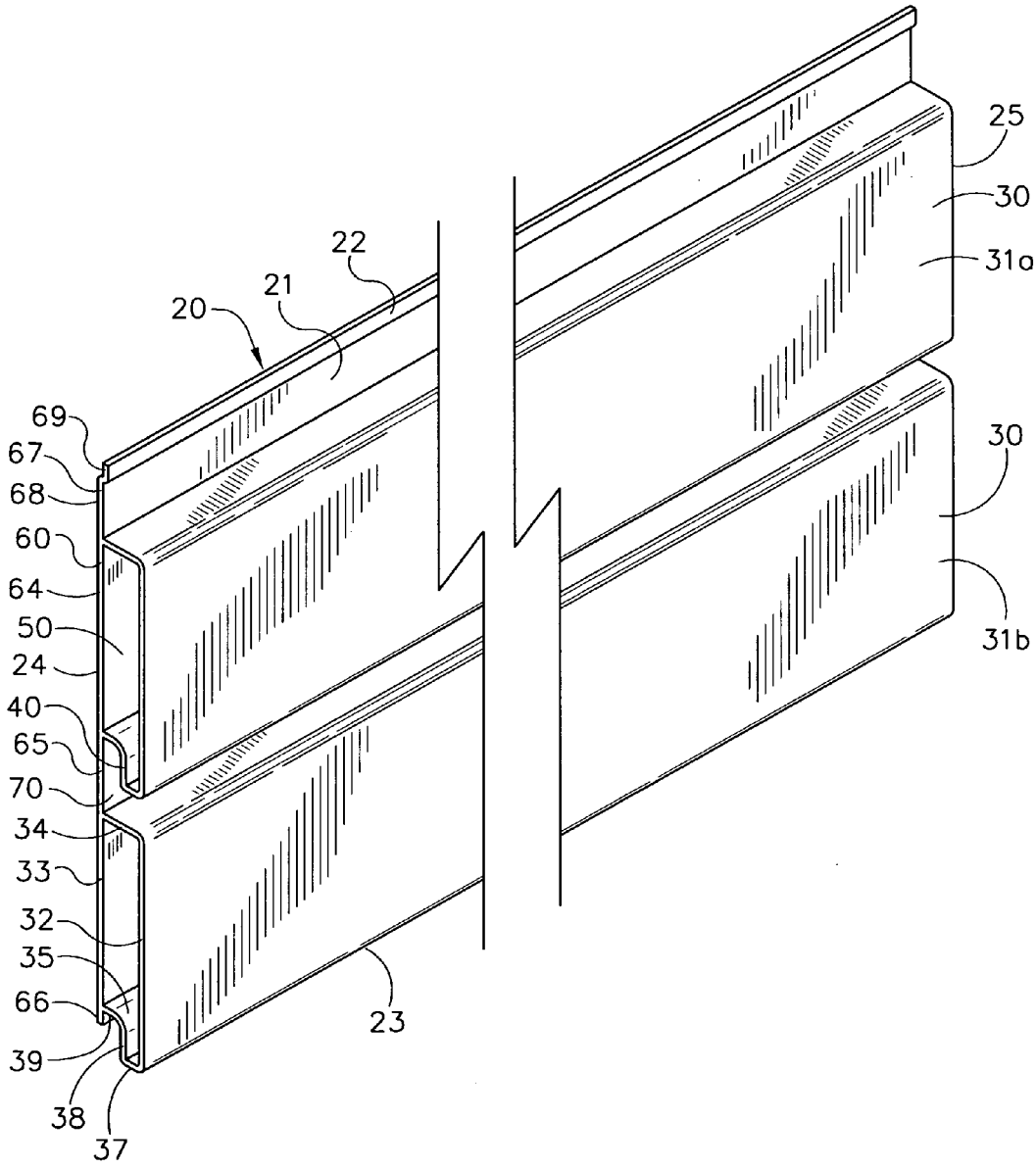
FIG. 2 is a perspective view of a slatwall section with two hollow boards and a continuous rear wall.
Figure 3:
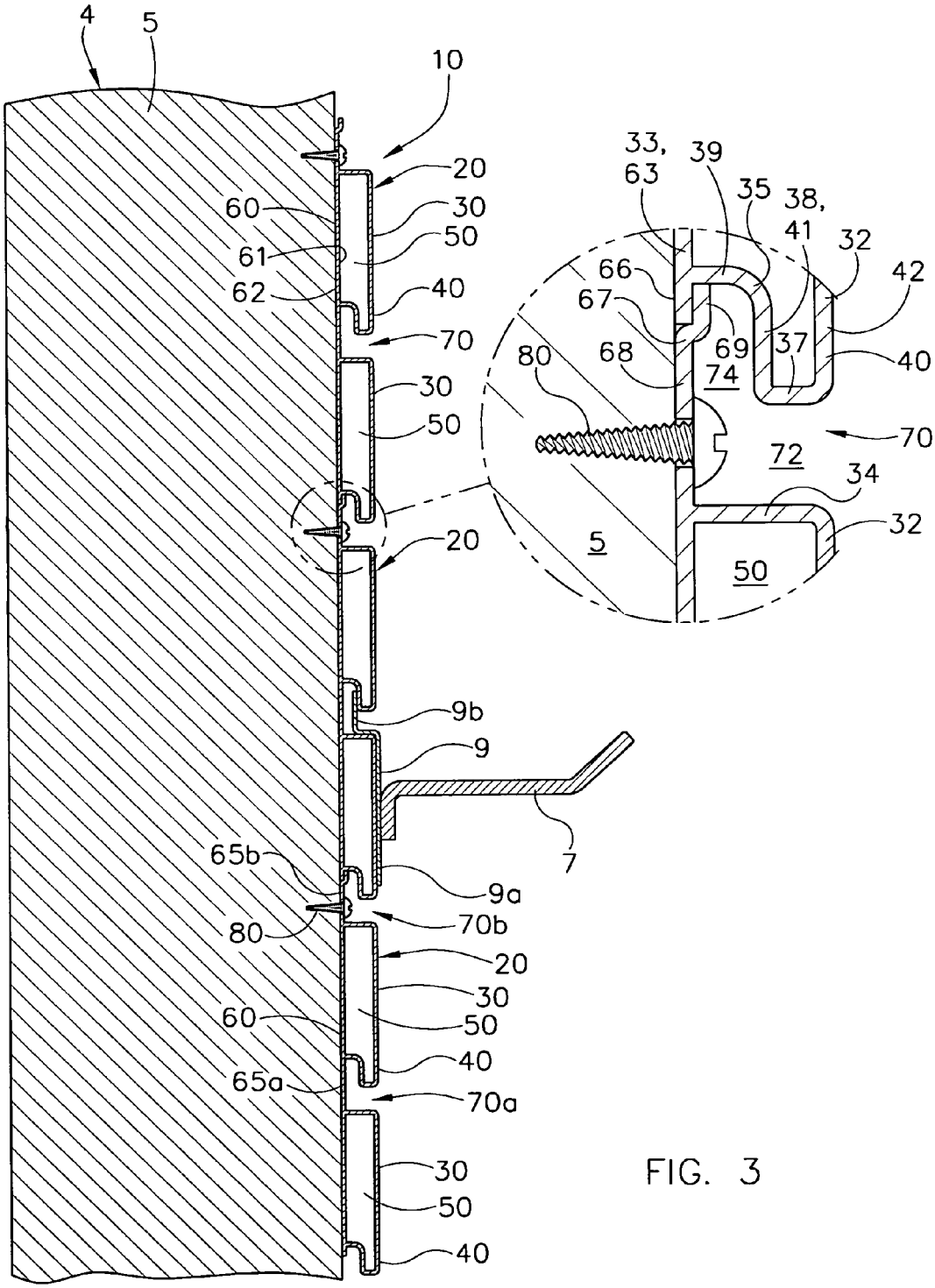
FIG. 3 is a side view of several slatwall sections lying flat against the wooden studs of a wall and secured to the studs with self tapping screw fasteners.
Figure 4:
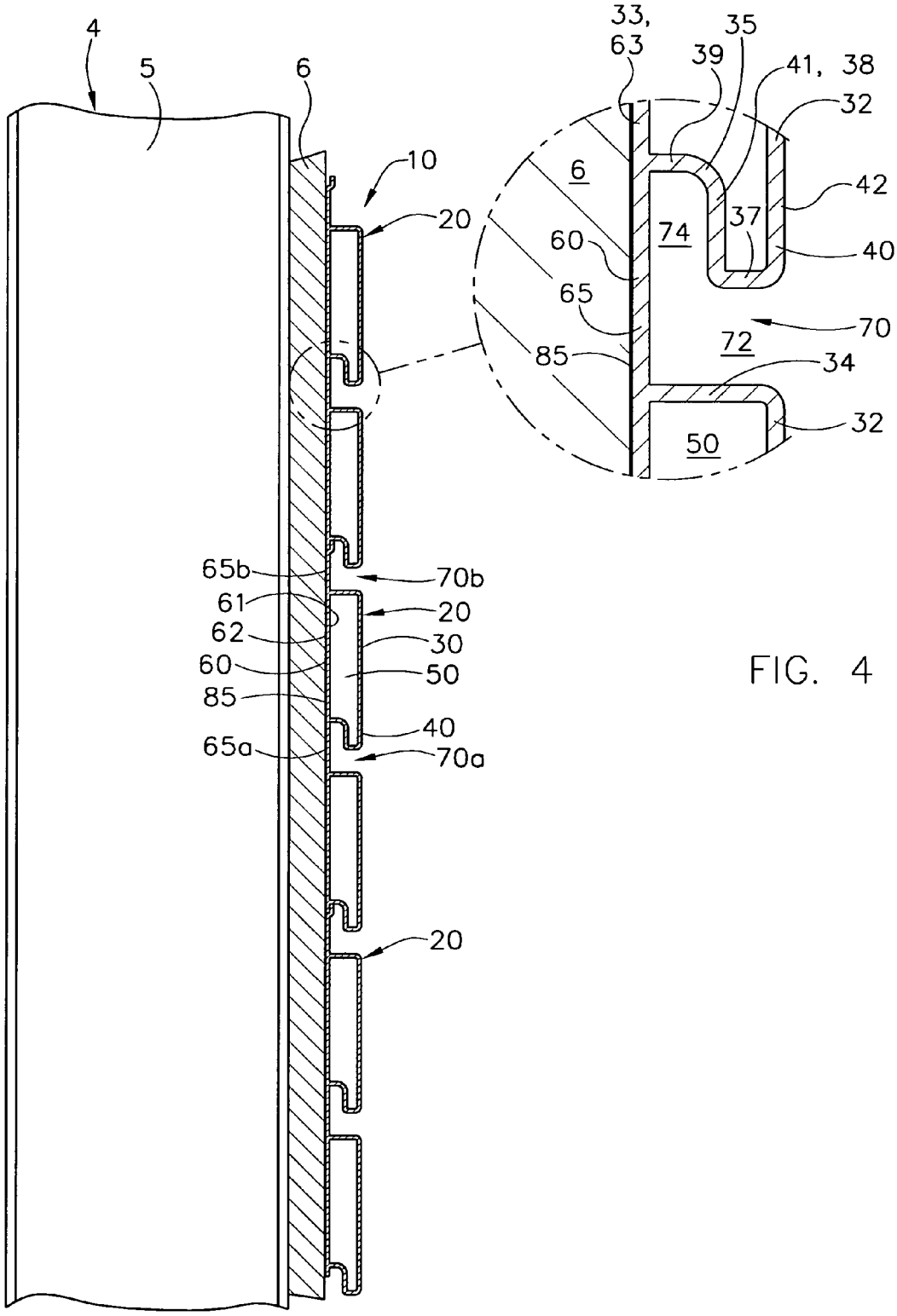
FIG. 4 is a side view of several slatwall sections laying uniformly flat against the drywall layer of a wall and secured directly to the drywall with an adhesive coating.

Each like-shaped board 30 has a generally rectangular shape when viewed from the front as in FIGS. 1 and 2, or from its side as in FIGS. 3 and 4. Each board 30 is about a ½ inch or 0.565 inches thick from front to back, and extends horizontally from one side 23 of the section 20 to the other 24. Each board 30 has a height of about 2⅝ inches or 2.625 inches and is spaced from its adjacent boards a vertical distance of about ⅜ inch or 0.375 inches, so that the total height of one board and space set is about three inches. The boards 30 are parallel and uniformly spaced apart when viewed from the front.

Each board includes a front wall 32, a rear wall 33, a top wall 34 and a bottom wall 35. The walls 32–35 of the boards 30 have a uniform thickness of about 1/16 inch or 0.065 inches for typical uses, but can vary depending on the desired board strength. The front and rear walls 32 and 33 are generally flat, in parallel registry and spaced about a half inch apart by the perpendicular top wall 34 and the bottom wall 35. The top wall forms a generally flat and continuous platform from its front end to its rear end. The bottom wall 35 has an arcuate shape formed by a lower portion 37 with a length of about ¼ inch or 0.29 inches, a rear facing portion 38 with a length of about ½ inch or 0.50 inches, and an upper portion 39 with a length of about ¼ inch or 0.22 inches. The lower and upper portion 37 and 39 are generally flat, in offset parallel registry, and spaced apart by the perpendicular rearward portion 38. The rearward portion 38 is generally flat, and is in parallel registry with and spaced from the front wall 32 by the perpendicular lower portion 37. The walls 32–35 are integrally joined at their ends to form a continuous wall or loop having a somewhat rectangular shape. The corners joining the top, front and bottom walls 32, 34 and 35, as well as bottom wall portions 38 and 39 are rounded to a radius of about ⅛ inch or 0.145 inches. The radius between bottom wall portions 37 and 38 is relatively small or about 1/16 inch or 0.085 inches to help keep the offset portion 9*b* of the hanger bracket 9 engaged with the lip 40.

Each board 30 forms a double-walled lip 40 that extends down about a half inch along its lower end. The lip 40 has an inner wall 41 formed by the rear portion 38 of the bottom wall 35, and an outer wall 42 formed by the lower end of the front wall 32. These two walls 41 and 42 are integrally joined and spaced apart by the lower portion 37 of the bottom wall 35. The walls 41 and 42 are parallel and spaced apart about ¼ inch or 0.29 inches. The spaced double-wall construction of the lip 40 provides a strong, rigid structure. The inner wall 38, 41 of the lip 40 is parallel to and spaced from the rear wall 33 about ¼ inch or 0.22 inches to receive and securely hold the bracket 9 or the hanger 7 or shelf 8.

A continuous rear wall 60 with front and rear surfaces 61 and 62 extends between the top and bottom ends 21 and 22 and side walls 23 and 24 of each slatwall section 20. The front and rear surfaces 61 and 62 form generally parallel plains. Similar to board walls 32–35, the continuous rear wall 60 has a uniform thickness of about 1/16 inch or 0.065 inches for typical uses, but this thickness can vary depending on the desired strength. The rear wall 60 includes alternating board segments 63 and spacer segments 65. The rear wall 33 of each board 30 is formed by one of the board segments 63. Each board segment 63 has a length of about two inches or 1.995 inches. One central spacer segment 65*a* is between each board segment 63. Each central spacer segment 65*a* has a vertical length of about ⅞ inch or 0.875 inches and uniformly spaces apart its adjacent boards 30. Joining spacer segments 65*b* are formed between the boards of adjacent sections 20 as discussed below.

Figure 5:
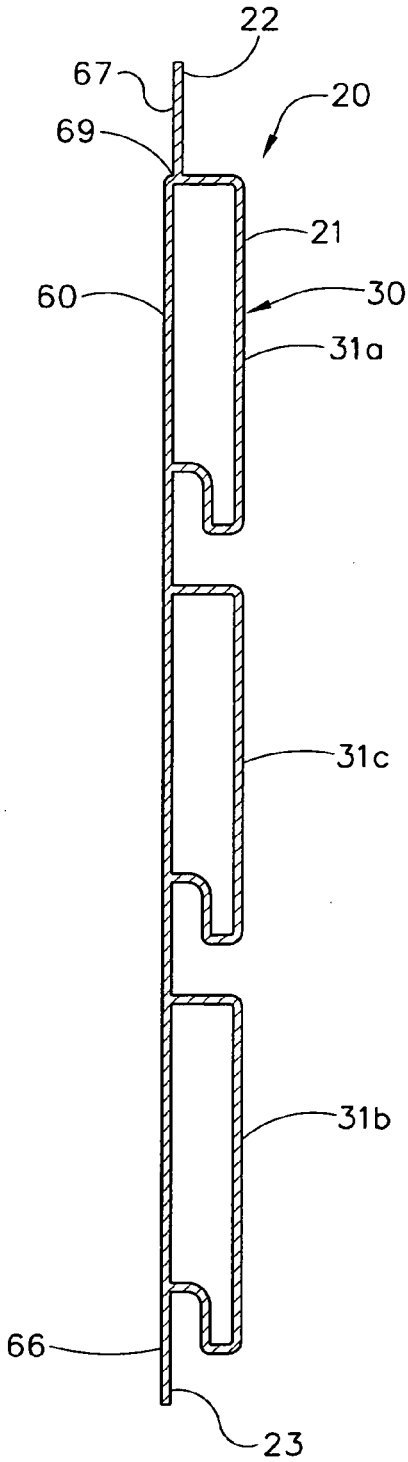
FIG. 5 is a side view of an embodiment of the slatwall with three boards and modified connector ends that overlap with an adjacent slatwall section when installed.
Figure 6:
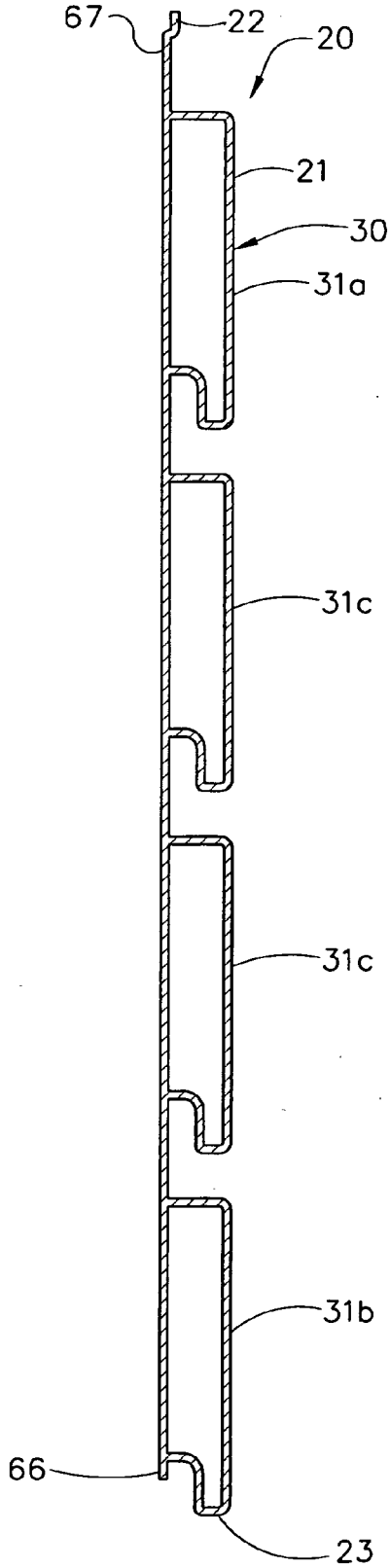
FIG. 6 is a side view of an embodiment of the slatwall with four boards.

Each slatwall section 20 has lower and upper connectors 66 and 67 that are preferably formed by or an extension of the rear wall 60. The upper connector 67 extends vertically up along the upper end 22 and has a length of about ⅞ inch or 0.861 inches. The lower connector 66 extends vertically down along the lower end 23 and has a length of about ⅛ inch or 0.185 inches. The connectors 66 and 67 extend from one side 24 to the other 25. When installed, the lower connector end 66 of one section 20 continuously abuts the upper connector 67 of an adjacent lower board as best shown in FIGS. 3 and 4. The upper connector 67 has a main portion 68 and an offset portion 69. The main portion 68 has a length of about ⅝ inch or 0.682 inches. The offset portion 69 has a length of about ⅛ or 0.179 inches, and is offset about 1/16 inch or 0.75 inches from the main portion 68 to form a slot for matingly receiving and overlap the lower connector 66 of its adjacent upper board. The abutting ends of the connectors 66 and 67 are parallel. The lower connector 66 and the main portion 68 of the upper connector 67 combine to form the joining spacer segment 65*b* that has a length of about ⅞ inch or 0.867 inch and is substantially equal in length to the central spacer segment 65*a*. The adjacent boards 31*a* and 31*b* of separate abutting sections 20 are also spaced a uniform ⅜ inch or 0.375 inches apart by spacer segments 65*b*, which is the same or substantially the same as the spacing of the adjacent boards of the same section. The length of the lower and upper connectors 66 and 67 can be altered without departing from the board aspects of the invention provided they combine to equal one spacer segment. For example, FIG. 5 shows a section 20 with connectors 66 and 67 of equal length. Each connector 66 and 67 has a length equal to the length of one spacer segment 65. The upper connector 67 of one section 20 completely overlaps the lower connector 66 of an adjacent upper section when they are joined together. This complete or substantially complete overlap of the connectors 66 and 67 enables each screw to be driven through and join the adjacent sections 20 to produce a slatwall assembly 10 that is more securely attached to the wall 4.

A slot 70 is formed between each set of two adjacent boards 30 and the corresponding spacer segment 65 between these boards. A central slot 70*a* is formed between two boards 31*a*–*c* and central spacer section 65*a* of a single section 20. An adjoining slot 70*b* is formed between the boards 31*a* and 31*b* and joining spacer segment 65*b* of two adjacent sections 20. Each like-shaped slot 70 has merging outer and inner portions 72 and 74 as best shown in FIGS. 3 and 4. The outer portion 72 is located immediately above the top wall 34 of the lower board 30 and is relatively narrow or horizontally flat with a height of about ⅜ inch or 0.375 inches. The narrow outer portion 72 forms an opening between the front walls 32 of the adjacent boards 30 and extends back toward the rear wall 33. The inner portion 74 is located immediately in front of the rear wall 33 and is relatively wide or vertically tall with a height of about ⅞ inch or 0.875 inches. The narrow and vertical portions 72 and 74 give the slot an L-shaped appearance when viewed from the side. Each slot 70 has the same L-shape, and is uniform along its length from one side 14 of the assembly 10 to the other 15. The narrow or flat outer portion 72 is formed by sizing the spacer segments 65 and 65*a* longer than the walls 41 and 42 of the lip 40, so that the lower portion 37 or 43 of the bottom wall 35 or lip 40 is spaced a desired distance from the top wall 34 of the lower board 30. The wide or tall inner portion 74 is formed by offsetting the bottom wall 35 up proximal the rear wall 35 to create the lip 40. The narrow outer portion 72 combines with the height of the lip 40 to form the taller inner portion 74.

The assembly 10 is installed by mounting the slatwall sections 20 to the wall 4 one at a time. The assembly is mounted directly against the studs 5 or over the drywall 6. Each section 20 is secured to the wall 4 with self-tapping screws 80 or an adhesive coating 85. The lowest section 20 of the assembly 10 is secured first. This section 20 should be properly leveled to ensure its upper longitudinal end 22 is horizontally level before the section is secured in place. This section 20 should also be positioned a desired distance from the ceiling so that a full section can be located along the ceiling. The second or next upper adjacent section is then aligned in abutting engagement with the first section so that its lower end 23 rests on the upper end 22 of the first or lower adjacent section. The lower connector 66 is received by or mates with the offset portion 69 of the upper connector 67 of the lower adjacent section to self align the upper adjacent section 20 before it is secured in place. Each of the other remaining sections 20 is similarly aligned and secured. Trim pieces (not shown) are used to cap the top 12 and sides 14 and 15 of the assembly 10, and aesthetically join the sides 24 and 25 of horizontally abutting sections 20.

When screws 80 are used to secure the sections 20, the screws should extend into each of the vertical studs 5 that are uniformly spaced at intervals of about 16 inches. The screws 80 are preferably Phillips pan head screws, #10×1½ inch.

The screws 80 are located along the horizontal length of the upper connector or leg 67 that completely or partially forms the upper spacer segment 65*a*. The screws pass through the connector 67 so that one screw joins the section 20 to each underlying stud 5. Screws 80 are similarly located along the center slot 70 of each section 20 so that one screw enters each underlying stud. A load supported by the top wall 34 of one board 30 passes up the rear wall 60 of that section, through the screws 80 and to the studs 5 of the wall 4. Mounted with proper hangers 7 and bracket hardware 9, each slatwall section 20 should support a downward load of twenty-five pounds at an effective distance of one foot from the front walls 32 of the slatwall section 20 without adversely deforming the slatwall sections. Heavier objects should be mounted directly over the screws for additional strength. The screws can be secured into the drywall 6 via conventional drywall anchors (not shown), but such a mounting will likely reduce the load carrying capacity of the assembly 10.

When an adhesive coating 85 is used to secure the slatwall sections 20 to the drywall layer 6, the coating is applied evenly between the rear surface of the continuous rear wall 60 of each section 20 and the outer surface of the drywall. A load supported by the top wall 34 of one of the boards 30 of that section 20 passes via the rear wall 60, adhesive coating 85 and drywall 6 to the studs 5 of the wall 4. The adhesive is preferably a construction grade adhesive appropriate for bonding plastic to materials such as drywall or plywood, and preferably contains active ingredients of resin acids, rosin acids, esters with glycerol, such as the Liquid Nails adhesive made by Macco of Cleveland Ohio. Mounted with proper hangers 7 and bracket hardware 9, each slatwall section 20 should support a downward load of twenty-five pounds at an effective distance of one foot from the front walls 32 of the slatwall section 20 without adversely deforming the slatwall sections.

While the invention has been described with reference to preferred embodiments, it will be understood by those skilled in the art that various changes may be made and equivalents may be substituted without departing from the broad aspects of the invention.

I claim:

1. A slatwall assembly for removably receiving and securing hangers and other display devices to a substantially vertical supporting surface, said slatwall assembly comprising:

a plurality of like-shaped, elongated slatwall sections, each of said sections having an integral one-piece body with top and bottom ends and adjacent boards that project forward from a continuous rear wall, each section including an upper board and a lower board, said continuous rear wall extending from proximal said top end to proximal said bottom end and having alternating and linearly aligned board segments and spacer segments, said spacer segments including at least one internal spacer segment that spaces apart its said adjacent boards and at least one external spacer segment, each board having spaced apart front, rear, top and bottom walls that form a loop around a chamber, said spaced apart rear wall being formed by said continuous rear wall, said top wall being substantially flat and each board defining a downwardly extending lip, each of said rear walls of said boards being formed by one of said board segments, and each of said at least one internal spacer segments combining with its said adjacent boards to form an elongated slot with a uniform L-shaped profile;

wherein said elongated slatwall sections are adapted for rigid securement to the supporting surface in substantial horizontal alignment to form adjacent slatwall sections, each of said adjacent slatwall sections including an upper section and a lower section, said top end of said lower section longitudinally being adapted to engage said bottom end of said upper section with at least one of said external spacer segments uniformly spacing adjacent upper and lower boards formed by said lower board of said upper section from said upper board of said lower section; and, wherein said at least one external spacer segment between each of said adjacent slatwall sections combines with its said adjacent upper and lower boards to form an additional elongated slot, each of said slots being like shaped and including an outer portion located along its said adjacent lower board and an inner portion located behind said lip of its said adjacent upper board, said inner portion being wider than said outer portion.

2. The slatwall assembly of claim 1, and wherein the hangers and display devices include a bracket with an upper offset portion and a lower portion, said offset portion being removably receivable by said slot, said offset portion resting on said top wall of said lower board forming said slot and said offset portion abutting said lip of said upper board forming said slot, and said lower portion abutting said front wall of at least one of said boards below said slot.

3. The slatwall assembly of claim 1, and wherein said lip is a double-walled lip with an outer wall formed by said front wall and an inner wall formed by said bottom wall, said inner and outer walls being spaced apart by a lower portion of said bottom wall.

4. The slatwall assembly of claim 1, and wherein said slatwall sections are extruded from high impact polystyrene.

5. The slatwall assembly of claim 4, and wherein said adjacent boards are located at three inch increments, said walls have a thickness of about 1/16 inch, and said slatwall sections support a load of 25 pounds at an effective distance of one foot from said front wall.

6. The slatwall assembly of claim 5, and wherein said supporting surface has a flat drywall layer and said continuous rear wall has a substantially flat rear surface to flushly engage the drywall layer, and wherein said assembly further includes a uniform adhesive coating between said continuous rear wall and the drywall layer to rigidly bond said slatwall sections to the drywall layer.

7. The slatwall assembly of claim 1, and wherein said chamber is web-free, and said front, rear, top and bottom walls form a continuous loop around said web-free chamber.

8. The slatwall assembly of claim 1, and wherein each of said slatwall sections has opposed side ends, and said boards and L-shaped slots extend continuously between said opposed side ends.

9. The slatwall assembly of claim 1, and wherein each of said slatwall sections has at least one middle board.

10. The slatwall assembly of claim 1, and wherein said top and bottom ends of each of said slatwall sections has one of said external spacer segments, said external spacer segments forming upper and lower connectors, said upper connector of said lower section combining with said lower connector of said upper section of said adjacent slatwall sections to form one of said external spacer segments.

11. The slatwall assembly of claim 10, and wherein one of said connectors has an offset portion to form a groove for matingly receiving said connector of said adjoining section.

12. An extruded slatwall section for securing hangers and other display devices to an upwardly extending supporting surface, said extruded slatwall section comprising:

a unibody section having top and bottom ends and spaced upper and lower boards projecting forward from a continuous rear wall that extends from proximal said top end to proximal said bottom end;

each board including spaced apart front, rear, top and bottom walls that form a continuous loop around a web-free chamber, said top wall being substantially flat and each board defining a downwardly extending double walled lip;

said continuous rear wall including alternating board segments and spacer segments, said rear wall of each of said boards being formed by one of said board segments, said boards being spaced apart by an adjoining spacer segment, said spaced apart rear wall forming said loop being formed by said continuous rear wall; and, an L-shaped slot formed between said boards and said adjoining spacer segment, said slot being between said top wall of said lower board and said bottom wall of said upper board, said slot having an outer portion and an inner portion, said inner portion being wider than said outer portion and located between said lip of said upper board and said spacer segment.

13. The extruded slatwall section of claim 12, and wherein said double-walled lip has an outer wall formed by said front wall and an inner wall formed by said bottom wall, said inner and outer walls being spaced apart by a lower portion of said bottom wall.

14. The extruded slatwall section of claim 12, and wherein said slatwall section is extruded from high impact polystyrene.

15. The extruded slatwall section of claim 14, and wherein said walls have a thickness of about 1/16 inch, and said slatwall section supports a load of 25 pounds at an effective distance of one foot from said front wall.

16. The extruded slatwall section of claim 12, and said slatwall section has opposed ends, and said boards and L-shaped slot extend continuously between said opposed side ends.

17. The extruded slatwall section of claim 12, and wherein said slatwall section has at least one middle board.

18. A slatwall extrusion for supporting hangers and display devices, said slatwall extrusion comprising:

an integral plastic unibody section having top and bottom ends;

a plurality of boards, each board having spaced apart front, rear, top and bottom walls that form continuous loop around a web-free chamber, said top wall being substantially flat and each board defining a downwardly extending double-walled lip;

a continuous rear wall having a plurality of alternating wall segments and spacer segments, said spacer segment spacing said top wall of an adjacent lower board form said bottom wall of an adjacent upper board, said spaced apart rear wall forming said loop being formed by said continuous rear wall; and, an L-shaped slot formed by said spacer segment and its adjacent top wall and bottom wall, said slot having an outer portion and an upwardly extending inner portion, said inner portion being wider than said outer portion and located between said spacer segment and said lip of its said adjacent bottom wall.

19. The slatwall extrusion of claim 18, and wherein said spacer segments are linearly aligned with said rear walls of said boards.

20. The slatwall extrusion of claim 19, and wherein each of said board sections are uniformly spaced and each of said board sections has a like-shaped cross-sectional shape.

* * * * *